US005278378A

United States Patent [19]

Beckett

[11] Patent Number: 5,278,378

[45] Date of Patent: Jan. 11, 1994

[54] MICROWAVE HEATING ELEMENT WITH ANTENNA STRUCTURE

[75] Inventor: D. Gregory Beckett, Oakville, Canada

[73] Assignee: Beckett Industries Inc., Oakville, Canada

[21] Appl. No.: 905,306

[22] Filed: Jun. 29, 1992

[30] Foreign Application Priority Data

Jun. 28, 1991 [GB] United Kingdom ..... 9114068

[51] Int. Cl.[5] ..... H05B 6/80

[52] U.S. Cl. ..... 219/728; 219/748; 426/107; 426/234

[58] Field of Search ..... 219/10.55F, 10.55E; 426/107, 426/234, 241, 243; 99/DIG.14; 451

[56] References Cited

U.S. PATENT DOCUMENTS 4,320,274 3/1982 Dehn ..... 219/10.55 E
4,398,994 8/1983 Beckett ..... 156/659.1
4,460,814 7/1984 Diesch et al. ..... 219/10.55 F
4,552,614 11/1985 Beckett ..... 156/640
4,972,059 11/1990 Wendt et al. ..... 219/10.55 E
4,992,636 2/1991 Namiki et al. ..... 219/10.55 E

*Primary Examiner*—Philip H. Leung
*Attorney, Agent, or Firm*—Sim & McBurney

[57] ABSTRACT

A microwave heating element is described which permits a more uniform microwave cooking of a foodstuff to be achieved. The element comprises a layer of electroconductive material having circular openings formed therethrough and arranged in an array that generates thermal energy when exposed to microwave energy and adjacent a foodstuff. An antenna is provided in at least some of the openings to guide microwave energy to and through the openings. The electroconductive material layer usually is adhered to a paperboard layer with an overlying polymeric film layer.

16 Claims, 1 Drawing Sheet

MICROWAVE HEATING ELEMENT WITH ANTENNA STRUCTURE

FIELD OF INVENTION

The present invention relates to a device for effecting heating of foodstuff by microwave energy.

BACKGROUND TO THE INVENTION

U.S. Pat. No. 4,972,059 (Wendt et al) describes a device for use in heating a foodstuff by microwave energy by employing a grid in conjunction with an electroconductive ring to impart a predetermined temperature profile to the foodstuff. The grid comprises a series of circular or hexagonally-shaped openings formed through a sheet of electroconductive material.

Exposure of such a grid to microwave energy, with the openings arranged in a specific array, and mounted on a paperboard sheet, but without the conductive ring, results in the generation of thermal energy in the metal region while little microwave energy passes through the openings to the foodstuff below the grid.

SUMMARY OF INVENTION

It now has been found that a more even heating effect can be obtained from a normally microwave opaque electroconductive material having a plurality of circular openings therethrough by providing a portion of the electroconductive material extending into the circular opening.

The portion of the electroconductive material extending into the openings acts somewhat like an antenna, guiding a portion of the microwave energy into the circular opening. A similar effect can be achieved by positioning multiple small circles of electroconductive material or a spiral of electroconductive material in each of the circular openings.

DESCRIPTION OF PREFERRED EMBODIMENT

Figure 1:
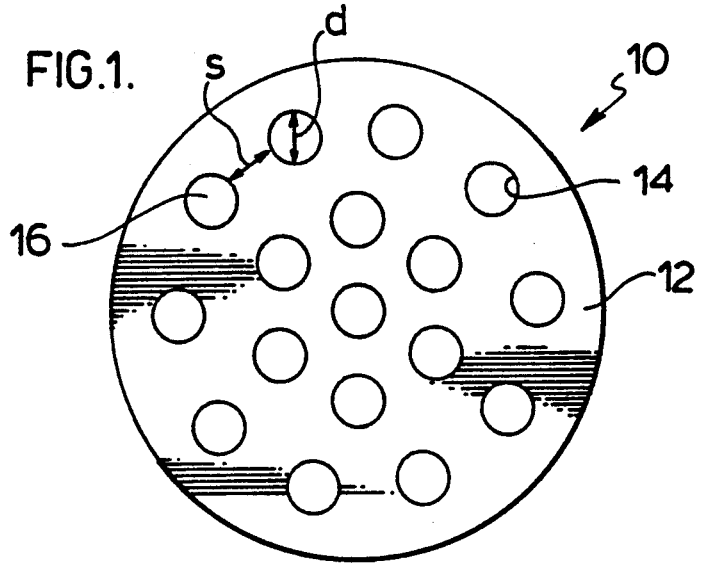
FIG. 1 is a plan view of a circular planar laminate structure comprising a layer of apertured aluminum foil supported on a cardboard layer.

Referring to the drawings, there is seen in FIG. 1 a grid structure 10 somewhat as generally disclosed in U.S. Pat. No. 4,972,059, referred to above. The grid structure comprises a layer 12 of electroconductive material which normally is substantially microwave transparent having a plurality of circular apertures 14 formed therethrough of diameter d and arranged in a uniform array spaced apart from one another by a distance s. The layer 12 of electroconductive material is mounted on a supporting substrate layer 16 of microwave transparent material. The layer 12 of electroconductive material may be overlied by a layer of polymeric material or other dielectric material.

The array of apertures 14 is arranged such that, when the laminate is exposed to microwave radiation, the electroconductive material layer 12 converts the incident microwave radiation to thermal energy and substantially no microwave energy passes through the apertures 14. In order to achieve this result (not disclosed in U.S. Pat. No. 4,972,059), a uniform array of circular openings each of the same diameter is employed, with the diameter (d) varying from about ¼ inch to about 11 inches, preferably about ½ inch to about 2 inches, and the spacing (s) varying from about ½ inch to about 4 inches, preferably about ¼ inch to about 1 inch.

The electroconductive material layer 12 generally is flexible and of a thickness which is normally opaque to microwave energy and which is supported by and adhered to the microwave transparent material layer 16. The minimum thickness varies with the material chosen. Generally, the electroconductive material layer 12 has a minimum thickness of about 1 micron. The flexible electroconductive material layer conveniently may be provided by aluminum foil having a thickness of about 1 to about 15 microns in thickness, preferably about 3 to about 10 microns, typically about 7 to about 8 microns. Other suitable electroconductive materials include stainless steel, copper and carbon.

The circular apertures 14 may be formed in the flexible electroconductive material layer in any convenient manner depending on the nature of the electroconductive material and the physical form of the electroconductive material.

For example, with the electroconductive material being a self-supporting aluminum foil layer, the apertures 14 may be stamped out using suitable stamping equipment, and then the stamped foil layer adhered to the substrate layer 16. Alternatively, and more preferably, with the electroconductive material being aluminum foil or other etchable metal supported on a polymeric film, such as by laminating adhesive, the apertures may be formed by selective demetallization of metal from the polymeric film using, for example, the procedure described in U.S. Pat. Nos. 4,398,994 and 4,552,614 and copending U.S. patent application Ser. No. 655,022 filed Feb. 14, 1991 ("DE-MET V"), all assigned to the assignee hereof and the disclosures of which are incorporated herein by reference, wherein an aqueous etchant is employed to remove aluminum from areas unprotected by a pattern of etchant-resistant material. Another possible procedure involves the use of ultrasonic sound to effect such selective demetallization.

The flexible layer of electroconductive material, which may be supported on a heat-resistant polymeric film for the purposes of selective demetallization, is laminated to paper or paperboard 16 to provide the grid structure 10, or to a heat-resistant polymeric material substrate, which may be flexible or rigid.

In the present invention, the thermal energy generation which results when the grid structure 10 is exposed to microwave radiation is rendered more uniform over the structure. This result may be achieved by providing, in effect, an antenna for microwave radiation in each selected ones or all of the openings.

Figure 2:
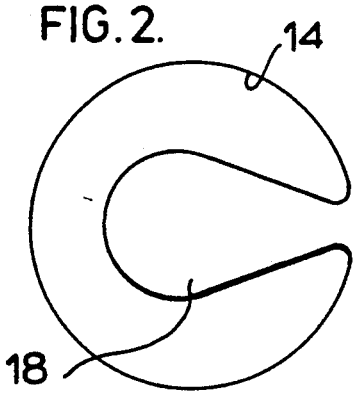
FIG. 2 is a close-up view of one embodiment of structure designed to provide more even generation of thermal energy from the laminate.

FIGS. 2 to 5 illustrate four structures which may be employed to achieve this result. Shown in each Figure is a single one of the plurality of apertures 14. In FIG. 2, the periphery of the aperture 14 extends into the aperture itself, to define a peninsular 18 of electroconductive material occupying a portion of aperture 14.

Figure 3:
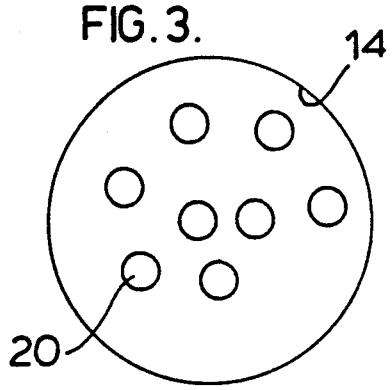
FIG. 3 is a close-up view of a second embodiment of structure designed to provide more even generation of thermal energy from the laminate.
Figure 4:
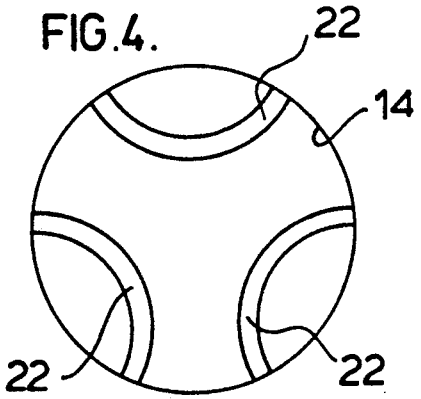
FIG. 4 is a close-up view of a third embodiment of structure designed to provide more even generation of thermal energy from the laminate.
Figure 5:
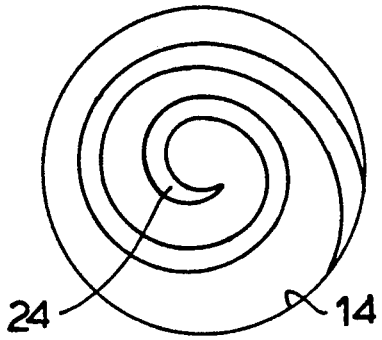
FIG. 5 is a close-up view of a fourth embodiment of structure designed to provide more even generation of thermal energy from the laminate.

In FIG. 3, a plurality of small islands 20 of electroconductive material are situated within the periphery of the aperture 14. In FIG. 4, continuous strips 22 of electroconductive material extends inwardly from the periphery of the aperture 14. In FIG. 5, a spiral 24 of electroconductive material is located within the aperture 14.

The various structures illustrated in FIGS. 2 to 5 are most conveniently formed by selective demetallization, using one of the procedures described above.

The effect of the provision of the antenna in the openings is to draw microwave energy to and through the plurality of openings, in contrast to the structure lacking such antenna, thereby achieving an overall improved heating of a foodstuff adjacent the structure.

SUMMARY OF DISCLOSURE

In summary of this disclosure, the present invention provides a novel microwave heating element comprising a layer of electroconductive material having circular openings formed therethrough and arranged in an array which produces thermal energy when exposed to microwave radiation and antenna means in at least some of the apertures to guide microwave energy to and through the openings, whereby a more uniform heating of a foodstuff may be achieved. Modifications are possible within the scope of this invention.

What I claim is:

1. A microwave heating element, comprising a layer of electroconductive material having circular openings formed therethrough and arranged in an array that generates thermal energy when exposed to microwave energy and adjacent a foodstuff, and antenna means in at least some of said openings to guide microwave energy to and through the openings, whereby a more uniform heating of a foodstuff may be achieved.

2. The element of claim 1 wherein said layer of electroconductive material is adhered to a microwave-opaque substrate layer.

3. The element of claim 2 wherein said microwave-opaque substrate layer is paper or paperboard.

4. The element of claim 3 wherein said layer of electroconductive material also is adhered to a layer of polymeric material on the opposite side from said paper or paperboard.

5. The element of claim 1 wherein said antenna means comprises a plurality of islands of said electroconductive material provided in said openings.

6. The element of claim 1 wherein said antenna means comprises a protrusion of electroconductive material extending from the periphery of the opening into the opening.

7. The element of claim 6 wherein said protrusion comprises a rounded head portion located at the centre of the opening and an elongate neck portion joining the round head portion to the periphery.

8. The element of claim 1 wherein said antenna means comprises a spiral of said electroconductive material extending from the periphery of the opening to adjacent the centre of the opening.

9. The element of claim 1 wherein said antenna means comprises a plurality of strips of said electroconductive material extending from the periphery of the opening into the opening.

10. The element of claim 9 wherein said strips of electroconductive materials are of equal length and width and arranged in a uniform array of arcs.

11. The structure of claim 1 wherein said openings are formed in a uniform array, having a diameter from about ¼ to about 11 inches and spaced apart by about ⅛ to about 4 inches.

12. The structure of claim 11 wherein said openings have a diameter of about ½ to about 2 inches and are spaced apart from ¼ to about 1 inch.

13. The structure of claim 1 wherein said electroconductive material layer is flexible and has a thickness of at least about 1 micron.

14. The structure of claim 13 wherein said electroconductive material layer has a thickness of about 1 to about 15 microns.

15. The structure of claim 14 wherein said electroconductive material layer has a thickness of about 3 to about 10 microns.

16. The structure of claim 15 wherein said electroconductive material layer has a thickness of about 7 to 8 microns.

* * * * *